US007997452B2

(12) United States Patent
Kim et al.

(10) Patent No.: US 7,997,452 B2
(45) Date of Patent: Aug. 16, 2011

(54) REFRIGERATOR RELATED TECHNOLOGY

(75) Inventors: Dong Jeong Kim, Seoul (KR); Seong Jae Kim, Seoul (KR); Kyung Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 724 days.

(21) Appl. No.: 12/016,269

(22) Filed: Jan. 18, 2008

(65) Prior Publication Data

US 2008/0173027 A1 Jul. 24, 2008

(30) Foreign Application Priority Data

Jan. 18, 2007 (KR) ..... 10-2007-0005517

(51) Int. Cl.
*B67D 7/06* (2010.01)

(52) U.S. Cl. ..... 222/182; 222/146.6; 62/389

(58) Field of Classification Search ..... 222/182, 222/146.6, 146.1, 530–538, 129, 129.1, 639–642; 62/389–400, 98, 56, 459, 336
See application file for complete search history.

(56) References Cited

U.S. PATENT DOCUMENTS

| | | | | |
|---|---|---|---|---|
| 2,078,097 | A | | 4/1937 | Radzinsky |
| 2,126,491 | A | | 8/1938 | McCartha |
| 2,462,743 | A | | 2/1949 | Handel |
| 2,512,395 | A | | 6/1950 | Sundberg |
| 3,429,140 | A | | 2/1969 | White |
| 3,476,295 | A | | 11/1969 | Telfer |
| 3,747,363 | A | | 7/1973 | Grimm |
| 3,851,939 | A | | 12/1974 | Benasutti |
| 4,209,999 | A | | 7/1980 | Falk |
| 4,227,383 | A | | 10/1980 | Horvay |
| 4,252,002 | A | | 2/1981 | Mullins, Jr. |
| 4,284,212 | A | | 8/1981 | Caswell |
| 4,739,629 | A | | 4/1988 | True |
| 5,112,477 | A | | 5/1992 | Hamlin |
| 5,269,154 | A | | 12/1993 | Schmidt |
| 5,272,888 | A | * | 12/1993 | Fisher et al. ..... 62/344 |
| 5,297,400 | A | | 3/1994 | Benton |
| 5,490,547 | A | | 2/1996 | Abadi |
| 5,542,265 | A | | 8/1996 | Rutland |
| 5,683,015 | A | | 11/1997 | Lee |
| 5,797,524 | A | | 8/1998 | Lentz |
| 5,927,557 | A | | 7/1999 | Busick |
| 5,956,967 | A | | 9/1999 | Kim |
| 6,050,097 | A | | 4/2000 | Nelson |
| 6,082,130 | A | | 7/2000 | Pastryk |

(Continued)

FOREIGN PATENT DOCUMENTS

EP 0 449 061 3/1991

(Continued)

OTHER PUBLICATIONS

Korean Office Action (Appln No. 10-2007-0005517) dated Nov. 6, 2007, with English Translation, 12 pages.

(Continued)

*Primary Examiner* — Lien T Ngo
(74) *Attorney, Agent, or Firm* — Fish & Richardson P.C.

(57) ABSTRACT

A refrigerator includes a dispenser including a moving chute configured to move from a stored position in which an outlet of the moving chute is positioned in a space defined in a refrigerator door to an operable position in which the outlet of the moving chute is positioned outside of the refrigerator door.

23 Claims, 13 Drawing Sheets

U.S. PATENT DOCUMENTS

| | | | | |
|---|---|---|---|---|
| 6,101,835 | A | 8/2000 | Butsch | |
| 6,135,173 | A | 10/2000 | Lee | |
| 6,148,624 | A | 11/2000 | Bishop | |
| 6,286,324 | B1 | 9/2001 | Pastryk | |
| 6,314,745 | B1 | 11/2001 | Janke | |
| 6,351,958 | B1 | 3/2002 | Pastryk | |
| 6,595,021 | B2 | 7/2003 | Skinner | |
| 6,648,187 | B1 | 11/2003 | Shypkowski | |
| 6,651,449 | B2 | 11/2003 | Heims | |
| 6,679,082 | B1 | 1/2004 | Tunzi | |
| 7,007,500 | B2 | 3/2006 | Lee | |
| 7,316,121 | B2 | 1/2008 | Lee | |
| 7,383,689 | B2 * | 6/2008 | Lee et al. | 62/98 |
| 2001/0030201 | A1 | 10/2001 | Gerhardt | |
| 2003/0032388 | A1 | 2/2003 | Rasmussen et al. | |
| 2005/0056043 | A1 | 3/2005 | Lee | |

FOREIGN PATENT DOCUMENTS

| | | | |
|---|---|---|---|
| JP | 50-69644 | | 6/1975 |
| JP | 51-4116 | | 2/1976 |
| JP | 51-21164 | | 2/1976 |
| JP | 58-74086 | | 10/1989 |
| JP | 2002-115960 | | 4/2002 |
| KR | 2001-0005331 | | 1/2001 |
| KR | 10-0296800 | B1 | 5/2001 |
| KR | 10-2004085586 | A | 10/2004 |
| KR | 10-0510698 | B1 | 8/2005 |

OTHER PUBLICATIONS

Korean Notice of Allowance (Appln No. 10-2007-0005517) dated Oct. 21, 2008, with English Translation, 3 pages.

International Search Report and Written Opinion (Appln No. PCT/KR2008/000313) dated Jan. 18, 2008, 10 pages.

* cited by examiner

REFRIGERATOR RELATED TECHNOLOGY

CROSS REFERENCE TO RELATED APPLICATIONS

This application claims the benefit of Korean Patent Application No. 10-2007-0005517, filed on Jan. 18, 2007, which is hereby incorporated by reference for all purposes as if fully set forth herein.

BACKGROUND

1. Field of the Disclosure

The present disclosure relates to a refrigerator including a dispenser.

2. Discussion of Related Art

A refrigerator is a representative chilling apparatus and, generally, includes a freezing compartment and a refrigerating compartment. The refrigerating compartment is kept at a temperature of about 3 to 4° C., to store food and vegetables in a fresh state for a prolonged period of time. The freezing compartment is kept at a temperature of below zero, to store meat and other food in a frozen state.

A refrigerator may include an ice maker capable of automatically performing a series of processes associated with the making of ice, without requiring a specific action of the user. A refrigerator also may include a dispenser configured to allow the user to dispense ice or water from the refrigerator without opening the refrigerator.

SUMMARY

In one aspect, a refrigerator includes a door having a front frame and a rear frame. The front frame and the rear frame define an interior of the door. The refrigerator also includes a dispenser. The dispenser includes a dispensing assembly configured for movement between a stored position and an operable position. The dispensing assembly includes a first moving chute configured to move in response to movement of the dispensing assembly from the stored position to the operable position. An outlet of the first moving chute is positioned in the interior of the door defined by the front frame and the rear frame when the dispensing assembly is positioned in the stored position and the outlet of the first moving chute is positioned outside of the door when the dispensing assembly is positioned in the operable position. The dispensing assembly also includes a second moving chute configured to move in response to movement of the dispensing assembly from the stored position to the operable position. The second moving chute and the first moving chute each define at least a portion of a passage through the door when the dispensing assembly is positioned in the operable position.

Implementations may include one or more of the following features. For example, when the dispensing assembly is positioned in the stored position, at least a portion of the first moving chute may be positioned inside the second moving chute. In this example, when the dispensing assembly moves from the stored position to the operable position, the portion of the first moving chute may extend from the second moving chute.

The dispensing assembly may include a dispensing cover configured to move outward from the front frame in response to movement of the dispensing assembly from the stored position to the operable position. The dispenser may include a fixed chute that, when the dispensing assembly is positioned in the operable position, has one end configured to communicate with the second moving chute and another end configured to communicate with an ice storing container. A combination of the fixed chute, the second moving chute, and the first moving chute may define an ice flow passage through the door when the dispensing assembly is positioned in the operable position.

In some examples, the dispenser may include a moving device configured to move the dispensing assembly from the stored position to the operable position. In these examples, the dispensing assembly may include a dispensing cover configured to move outward from the front frame in response to movement of the dispensing assembly from the stored position to the operable position, and the moving device may include a hinge configured to enable the dispensing cover to pivot with respect to the front frame. The moving device also may include an elastic member configured to generate an elastic force that is applied to the dispensing assembly to cause the dispensing cover to pivot outward from the front frame, and a coupling unit configured to couple the dispensing cover and the front frame against the force of the elastic member to retain the dispensing assembly in the stored position. The coupling unit may be released to enable the dispensing assembly to pivot from the stored position to the operable position. The coupling unit may include a first coupler mounted to one of the dispensing cover and the front frame, and a second coupler mounted to the other of the dispensing cover and the front frame.

In some implementations, the moving device may include a damper configured to control a movement speed of the dispensing assembly when the dispensing assembly moves from the stored position to the operable position. In these implementations, the damper may include a first gear mounted to one of the dispensing cover, the first moving chute, or the second moving chute, and a second gear mounted to one of the front frame or the rear frame in the interior of the door. The second gear may engage with the first gear.

The moving device also may include a guide configured to guide movement of the first moving chute and the second moving chute. The moving device further may include a connecting link configured to guide movement of the dispensing cover.

The dispensing assembly may include a dispensing cover configured to move outward from the front frame in response to movement of the dispensing assembly from the stored position to the operable position, and, when the dispensing assembly is positioned in the stored positioned, the dispensing cover may be substantially flush with the front frame of the door.

In some examples, the dispensing assembly may include a dispensing cover configured to move outward from the front frame in response to movement of the dispensing assembly from the stored position to the operable position, and a water discharge duct may be coupled to the dispensing cover, to enable dispensing of liquid water when the dispensing assembly is positioned in the operable position. In these examples, the water discharge duct may have a flexible portion configured to extend and retract based on movement of the dispensing assembly.

Further, the refrigerator may include a button configured to enable dispensing of water through the water discharge duct. The button may be positioned below the dispensing cover when the dispensing assembly is positioned in the operable position. An outlet of the first moving chute and an outlet of the water discharge duct may be positioned at a lower end of the dispensing cover and spaced apart from each other in a width direction of a refrigerator body. An outlet of the first moving chute and an outlet of the water discharge duct also may be positioned at a lower end of the dispensing cover and spaced apart from each other in a thickness direction of a refrigerator body.

The dispensing assembly may include a dispensing cover configured to move outward from the front frame in response to movement of the dispensing assembly from the stored position to the operable position, and a control panel may be provided on a front surface of the dispensing cover. The control panel may be configured to control the dispenser.

In some configurations, the dispensing assembly may include a third moving chute configured to move in response to movement of the dispensing assembly from the stored position to the operable position. In these configurations, the third moving chute, the second moving chute, and the first moving chute may each define at least a portion of a passage through the door when the dispensing assembly is positioned in the operable position. Further, in these configurations, when the dispensing assembly is positioned in the stored position, at least a portion of the first moving chute may be positioned inside the second moving chute and at least a portion of the second moving chute may be positioned inside the third moving chute. When the dispensing assembly moves from the stored position to the operable position, the portion of the first moving chute may extend from the second moving chute and the portion of the second moving chute may extend from the third moving chute.

The first moving chute and the second moving chute may not form a passage through the door when the dispensing assembly is positioned in the stored position. The first moving chute and the second moving chute may form a foldable structure such that the first moving chute and the second moving chute are in a folded position when the dispensing assembly is positioned in the stored position and the first moving chute and the second moving chute are in an unfolded position when the dispensing assembly is positioned in the operable position.

In another aspect, a refrigerator is controlled by receiving, at a control panel, a command to enable dispensing of ice or water. In response to receiving the command, a first moving chute is moved from a first position in which an outlet of the first moving chute is positioned behind a plane representing an outer surface of a refrigerator door and at least a portion of the first moving chute is positioned inside a second moving chute to a second position in which the outlet of the first moving chute is positioned in front of the plane representing the outer surface of the refrigerator door and the portion of the first moving chute extends from the second moving chute. The second moving chute is moved to a position in which the first moving chute and the second moving chute define a passage through the refrigerator door, and ice or water is dispensed through the refrigerator door using the passage defined by the first moving chute and the second moving chute. Movement of the first moving chute from the second position to the first position is enabled after dispensing the ice or water.

Implementations may include one or more of the following features. For example, a movement speed of the first moving chute may be controlled.

DETAILED DESCRIPTION

Figure 1:
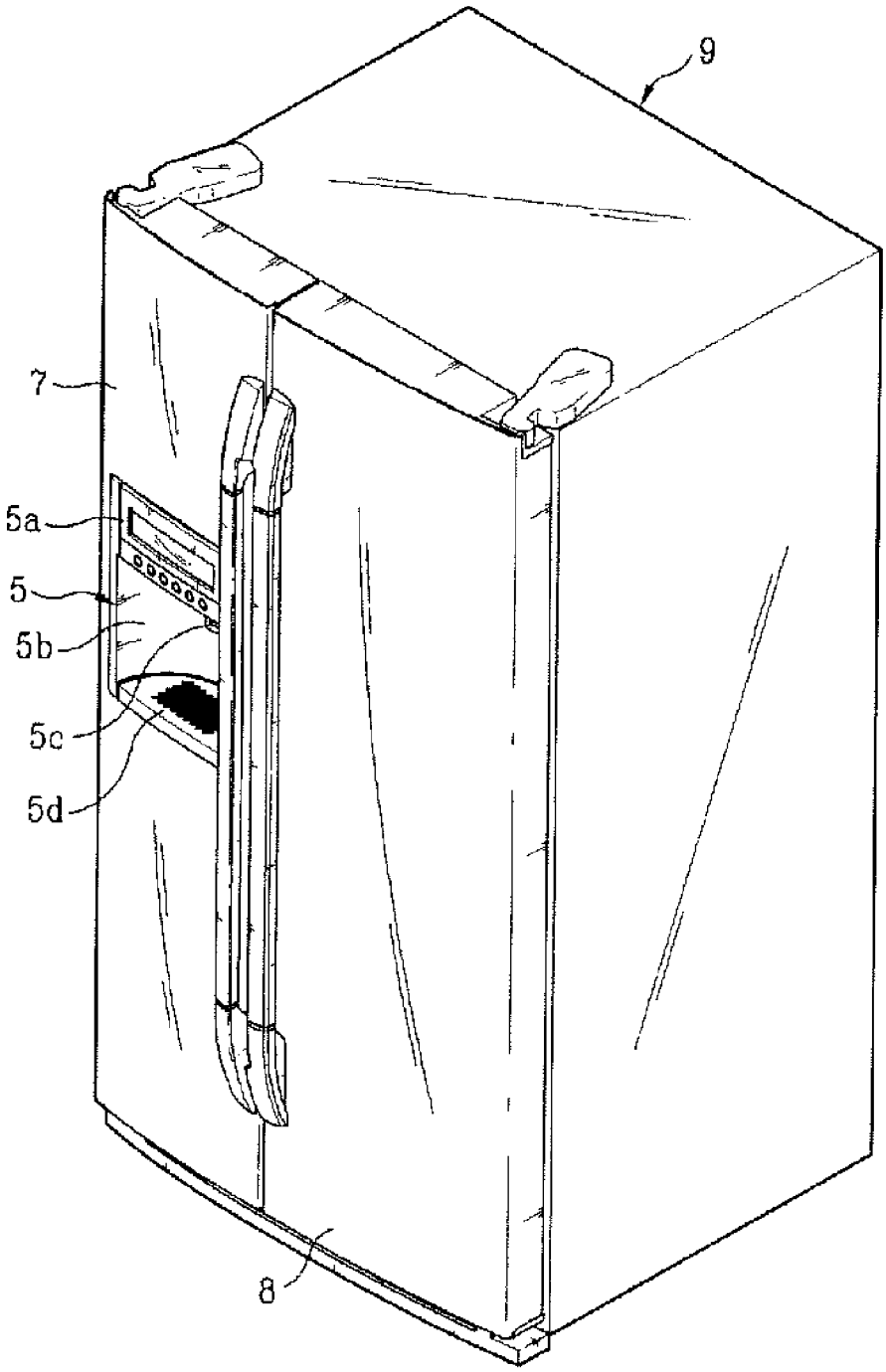
FIG. 1 is a perspective view illustrating a refrigerator including a dispenser.
Figure 2:
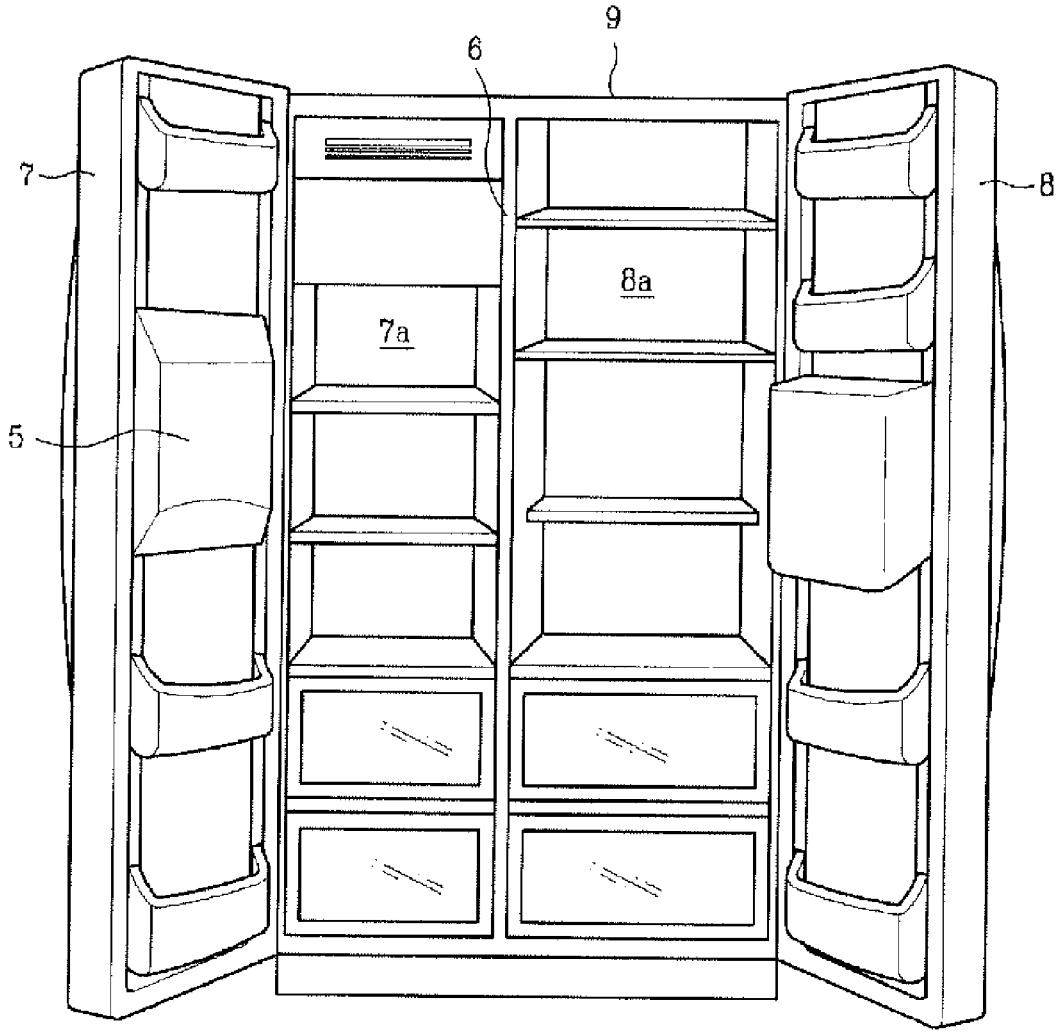
FIG. 2 is a perspective view of the refrigerator of FIG. 1, illustrating an opened position of refrigerator doors.

FIG. 1 illustrates a refrigerator including a dispenser, and FIG. 2 illustrates an opened position of the refrigerator doors of the refrigerator shown in FIG. 1. The refrigerator includes a refrigerator body 9 having a freezing compartment 7*a* and a refrigerating compartment 8*a*. The freezing compartment may be configured to store foods in a frozen state and the refrigerating compartment may be configured to store food in a chilled or refrigerated state. The refrigerator also includes refrigerator doors 7 and 8. The refrigerator door 7 is mounted to one side of the refrigerator body 9 to open and close the freezing compartment 7*a*, and the refrigerator door 8 is mounted to the other side of the refrigerator body 9 to open and close the refrigerating compartment 8*a*.

As shown, the freezing compartment 7*a* is provided at a left space of the refrigerator body 9, whereas the refrigerating compartment 8*a* is provided at a right space of the refrigerator body 9. A partition wall 6 is provided in the refrigerator body 9, to partition the interior of the refrigerator body 9 into the freezing compartment 7*a* and refrigerating compartment 8*a*.

The refrigerator doors 7 and 8 are mounted to a front side of the refrigerator body 9, to open and close the freezing compartment 7*a* and refrigerating compartment 8*a*, respectively.

A dispenser 5 is mounted to a front surface of the freezing compartment door 7, to allow the user to dispense ice or water out of the refrigerator without opening the refrigerator doors.

An ice maker (not shown) is installed at one side of the freezing compartment 7*a*, and is configured to produce ice. A water tank (not shown) is installed at one side of the refrigerating compartment 8*a*, and is configured to store water.

The dispenser 5 includes a dispensing space 5*b* extending into the interior of the freezing compartment door 7 in the form of a recess. The dispenser 5 also includes a control panel 5*a* mounted to the front surface of the freezing compartment door 7. The control panel 5*a* is configured to allow the user to input a command to select whether the user wishes to dispense water or ice. A dispensing duct (not shown), through which water or ice is dispensed, is arranged in the interior of the freezing compartment door 7. A lever or actuator 5*c* is provided on a rear surface of the structure defining the dispensing space 5*b*, and is configured to cause the dispenser 5 to open or close the dispensing duct to facilitate dispensing. A water tray 5*d* is arranged at the bottom of the dispensing space 5*b*, and is configured to receive residual water dispensed from the dispensing duct and not received in a container.

When the user desires to dispense ice, the user presses an ice button on the control panel 5*a*, and then pushes the lever or actuator 5*c* while bringing a container into contact with the lever or actuator 5*c* arranged in the dispensing space 5*b*. Based on the user pressing the lever or actuator 5*c*, the dispensing duct, which communicates with an ice storing container, is opened to allow ice from the ice storing container to be dispensed into the container used to contact the lever or actuator 5*c*.

When the user desires to dispense water, the user presses a water button on the control panel 5*a*, and then pushes the lever or actuator 5*c* while bringing the container into contact with the lever or actuator 5*c* arranged in the dispensing space 5*b*. Based on the user pressing the lever or actuator 5*c*, the dispensing duct, which communicates with the water tank, is opened to allow water from the water tank to be dispensed into the container used to contact the lever or actuator 5*c*.

As shown in FIG. 1, the dispensing space 5*b* extends into the interior of the freezing compartment door in the form of a recess and occupies a certain space even when the dispenser is not used. Because the dispensing space occupies a certain space even when the dispenser is not used, a refrigerator with a dispensing space may have limited use of an inner space of the refrigerator door.

In addition, because the dispensing space extends into the interior of the freezing compartment door in the form of a recess, as mentioned above, a container may not be used to receive water or ice when the container has a volume that is larger than the dispensing space or that is unsuitable for the dispensing space. This may limit the number of containers that a user may use to receive water or ice.

Figure 3:
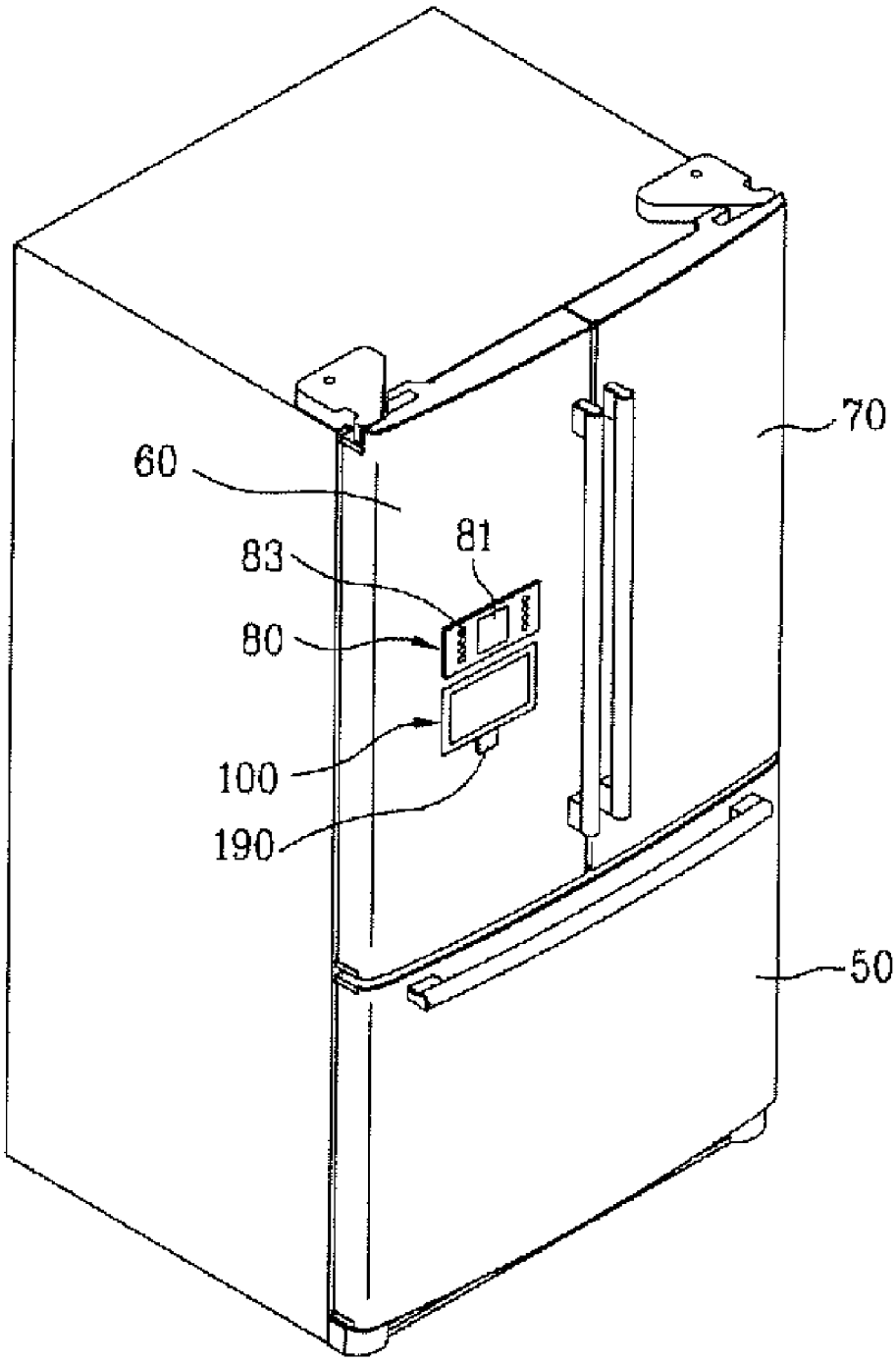
FIG. 3 is a perspective view illustrating a refrigerator including a dispenser.

FIG. 3 shows a refrigerator including a dispenser. The refrigerator includes freezing and refrigerating compartments to store food. A freezing compartment door 50 and refrigerating compartment doors 60 and 70 are arranged at front sides of the freezing and refrigerating compartments, respectively. The freezing compartment is arranged beneath the refrigerating compartment. The refrigerating compartment may be divided into two sections, which may or may not be separated by a partition wall.

In some implementations, the refrigerating compartment includes a first refrigerating compartment and a second refrigerating compartment. In these implementations, the refrigerating compartment door 60 functions as a first refrigerating compartment door that is configured to open and close the first refrigerating compartment, and the refrigerating compartment door 70 functions as a second refrigerating compartment door that is configured to open and close the second refrigerating compartment. The first and second refrigerating compartment doors 60 and 70 may be pivotally coupled to opposite side walls of a refrigerator body by hinges such that they may be pivotally opened and closed in left and right directions. The freezing compartment door 50 may be opened and closed in a sliding manner in forward and rearward directions of the refrigerator body.

The freezing and refrigerating compartment doors may be arranged at various positions in accordance with the positions of the freezing and refrigerating compartments. For example, the refrigerator may include various styles of refrigerators, for example, top mount and side-by-side style refrigerators. The refrigerator doors may correspond to the shape of the refrigerator and may include one or many doors.

A dispenser 100 is arranged at the front side of a refrigerating compartment door, and is configured to dispense a content, such as water or ice. A control panel 80 is arranged above the dispenser 100, and is configured to control operation of the dispenser 100. The control panel 80 may includes buttons 83 with which a user may provide user input to the control panel 80. The control panel 80 also may include a display 81 configured to display information related to operation of the dispenser 100 and/or the refrigerator. A water dispensing lever or actuator 190 may be arranged beneath the dispenser 100. The lever or actuator 190 may be configured to enable dispensing of water or ice.

Figure 4:
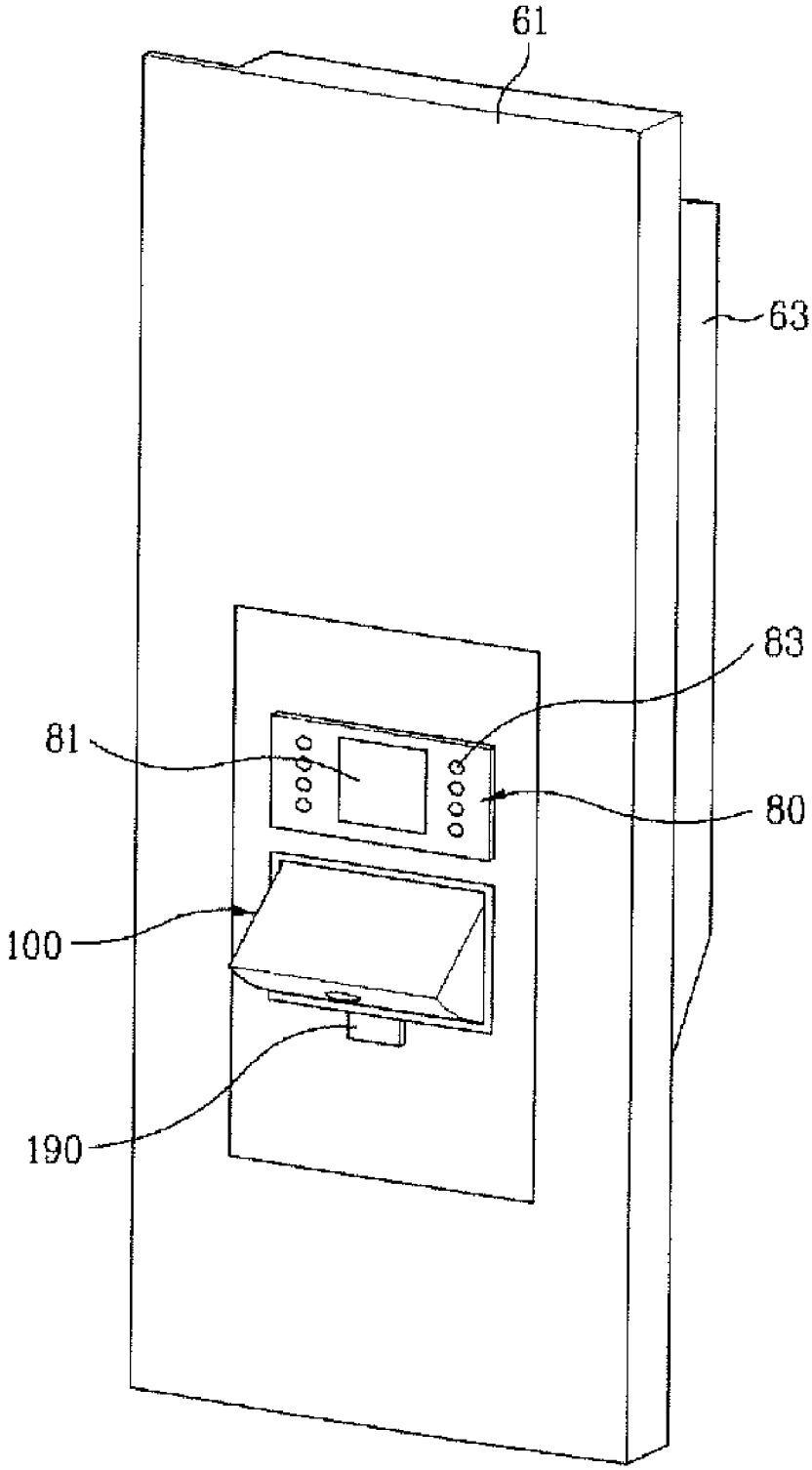
FIG. 4 is a perspective view of a portion of a refrigerator corresponding to a front surface of a door, illustrating a dispenser in an operable position.

FIG. 4 illustrates a portion of a refrigerator corresponding to a front surface of a door. As shown, the first refrigerating compartment door 60 includes a front frame 61 and a rear frame 63. When the door 60 is attached to the refrigerator and in a closed position, the front frame 61 is exposed to the outside of the refrigerator, and the rear frame 63 is exposed to the inside of the refrigerator body.

The front frame 61 and the rear frame 63 define a space in the refrigerating compartment door 60. An ice maker (not shown), which is configured to communicate with the freezing compartment and produce ice, an ice storing container (not shown), which is configured to store the ice produced by the ice maker, and a water tank, which is configured store water, may be installed in the space defined in the door 60 by the front frame 61 and the rear frame 63. In some implementations, the ice maker, ice storing container, and water tank may be installed in the refrigerator body, or may be installed at the freezing compartment door 50.

The dispenser 100 may be partially arranged in the space, and may be connected to the water tank and ice storing container to allow dispensing of water or ice.

Figure 5:
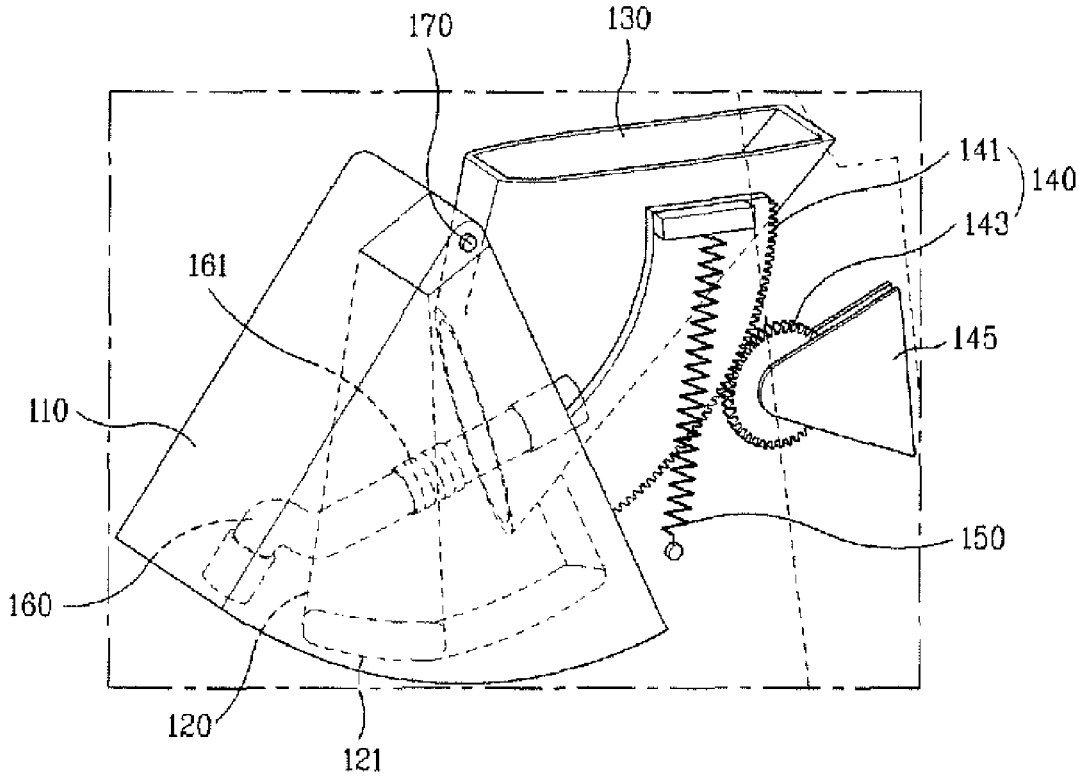
FIG. 5 is a partial perspective view illustrating an example of a dispenser.

FIG. 5 depicts an example of the dispenser 100. As shown, the dispenser 100 includes a moving chute 120 which is configured to move between an operable position and a stored position. When the moving chute 120 is in the operable position, at least a portion of the moving chute 120 is positioned outside of the front frame 61, and the moving chute 120 forms a passage for discharging ice. When the moving chute 120 is in the stored position, the moving chute 120 is positioned in the space defined between the front frame 61 and the rear frame 63. The dispenser 100 also includes a dispensing cover 110, which may be positioned outside of the front frame 61 together with the moving chute 120 when the moving chute 120 rotates from the stored position to the operable position. In some implementations, in the stored position, the dispensing cover 110 may rest against the door 60 or may be positioned in a plane parallel to the outer surface of the door 60. In these implementations, the dispensing cover 110 may cover the opening of the space defined in the door 60 by the front frame 61 and the rear frame 63.

In some examples, the dispensing cover 110 and moving chute 120 may be integrated. In these examples, the dispensing cover 110 and moving chute 120 may form a single dispensing housing or dispensing assembly. The dispensing cover 110 may define the appearance of the dispensing housing, and the moving chute 120 may define the interior of the dispensing housing. Accordingly, the dispensing cover 110 and moving chute 120 may move together, and the moving chute 120 may move to enter or exit the inner space of the door 60.

The dispenser 100 also includes a fixed chute 130 having a first end configured to communicate with the moving chute 120, and a second end configured to communicate with an ice storing container, which stores ice. The fixed chute 130 may be arranged in the space defined between the front frame 61 and the rear frame 63. The fixed chute 130 may be fixed in the space by fasteners (not shown), such as bolts and nuts, or hooks.

The moving chute 120 may have a length that enables the moving chute 120 to always communicate with the fixed chute 130, irrespective of whether the moving chute 120 is in an operable position (e.g., positioned outside of the front frame 61) or in a stored position (e.g., positioned in the space defined in the door 60 by the front frame 61 and the rear frame 63).

An ice discharge duct ("290" in FIG. 11A) may be installed in the space defined between the front frame 61 and the rear frame 63, and may be configured to define a passage between the ice storing container and the fixed chute 130. A duct cover ("280" in FIG. 11A) may be provided at an end of the ice discharge duct communicating with the fixed chute 130. The duct cover may be configured to open and close the ice discharge duct.

A moving device may be provided in the refrigerating compartment door 60, to move the dispensing cover 110 and moving chute 120. The moving device may be configured to move the dispensing cover 110 and moving chute 120 from a stored or closed position to an operable or open position such that the dispensing cover 110 and moving chute 120 are positioned outside of the front frame 61. The moving device may be configured to rotate or pivot the dispensing cover 110 and moving chute 120 from a stored or closed position to an operable or open position.

The moving device may include a hinge 170 that allows the dispensing cover 110 and the moving chute 120 to pivot or rotate with respect to the front frame 61. The moving device also may include an elastic member 150 (e.g., a spring) configured to provide an elastic force that causes the dispensing cover 110 and moving chute 120 to move from a stored position to an operable position in which the dispensing cover 110 and moving chute 120 are positioned outside of the front frame 61. The moving device further may include a coupling unit ("361" and "362" in FIGS. 12A and 12B) for coupling the dispensing cover 110 and the front frame 61 against the force of the elastic member 150. The coupling unit may hold the dispensing cover 110 and moving chute 120 in a stored or closed position, and release of the coupling unit may cause the dispensing cover 110 and moving chute 120 to move to the operable or open position.

The coupling unit will be described in more detail below with reference to FIGS. 12A and 12B.

The moving device further may include a damper 140 for adjusting the speed with which the dispensing cover 110 and moving chute 120 move during the movement of the dispensing cover 110. The damper 140 may include a first gear 141 mounted to one end of the moving chute 120, and a second gear 143 mounted to the inner surface of the front frame 61 by a mounting plate 145 such that the second gear 143 engages with the first gear 141. Alternatively, the first gear 141 may be coupled to one side of the dispensing cover 110, and the second gear 143 may be mounted to the inner surface of the front frame 61.

For the damper 140, any device configured to apply a relatively constant force to the dispensing cover 110 and moving chute 120 such that the dispensing cover 110 and moving chute 120 pivot at a constant speed may be used. For example, a gas spring, which is configured to apply a relatively constant force to the dispensing cover 110 and moving chute 120 against pivotal movement of the dispensing cover 110 and moving chute 120, may be used.

The hinge 170 may include hinge pins (not shown) formed at opposite ends of the dispensing cover 110, respectively, and hinge grooves (not shown) formed at an inner surface of the front frame 61 such that the hinge grooves correspond to the hinge pins. Accordingly, the dispensing cover 110 and moving chute 120 may be configured to pivot or rotate about the hinge pins.

The elastic member 150 may be arranged between one end of the first gear 141 and the inner surface of the front frame 61. In one example, when the dispensing cover 110 is in a closed or stored position, namely, when the moving chute 120 is inserted in the interior of the space defined in the door 60 by the front frame 61 and the rear frame 63, the elastic member 150 is in a compressed state. In this example, the elastic member 150 constantly applies a force to the moving chute 120 attempting to move the moving chute outwardly from the front frame 61. The elastic member 150 may apply the elastic force to the moving chute 120 and dispensing cover 110. In this example, the dispensing cover 110 and the moving chute 120 may be retained in the closed or stored position by the coupling unit.

In some implementations, one end of the elastic member 150 may be coupled to the moving chute 120 or dispensing cover 110, and the other end of the elastic member 150 may be coupled to the inner surface of the front frame 61. Although a spring has been described as an example of the elastic member, any type of elastic member may be used as long as it is configured to apply elastic force.

The refrigerator n may include a water discharge duct 160 coupled to the dispensing cover 110. The water discharge duct may define a passage for discharging water. The water discharge duct 160 may be configured to communicate with a water tank, which stores water for dispensing. An outlet ("163" in FIG. 6) of the water discharge duct 160 may be arranged at a lower end of the dispensing cover 110. The water discharge duct 160 may include a flexible portion 161. The flexible portion 161 may extend and retract to compensate for movement of the dispensing cover 110.

In some examples, when the dispensing cover 110 and moving chute 120 are positioned outside of the front frame 61 in an operable or open position in which ice or water may be dispensed, the water discharge duct 160 coupled to the dispensing cover 110 is moved together with the dispensing cover 110 and moving chute 120. In these examples, an outlet of the water discharge duct is positioned outside of the front frame 61 so that water may be discharged out of the outlet of the water discharge duct 160 when the dispensing cover 110 and moving chute 120 are in the operable or open position.

When the user presses a button, the dispensing cover 110 and the moving chute 120 may be moved or extended outside of the front frame 61. In this position, ice may be discharged through an outlet 121 of the moving chute 120, and water may be discharged through the outlet 163 of the water discharge duct 160.

Figure 6:
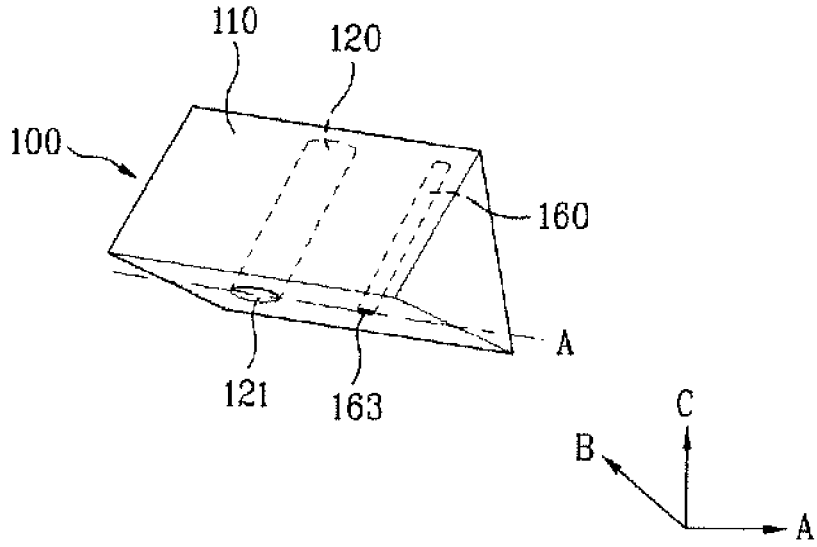
FIG. 6 is a perspective view illustrating an example of a dispensing housing, which may be included in a refrigerator.

FIG. 6 illustrates an example of a dispensing housing. As shown in FIG. 6, the moving chute 120 and water discharge duct 160 may be arranged such that the outlet 121 of the moving chute 120 and the outlet 163 of the water discharge duct 160 are positioned at a lower end of the dispensing cover 110. The outlet 121 of the moving chute 120 and the outlet 163 of the water discharge duct 160 may be spaced apart from each other in a width direction A of the refrigerator body. In this example, the user may selectively dispense water or ice out of the dispenser 100. In FIG. 6, "B" represents a thickness direction of the refrigerator body, and "C" represents the length direction of the refrigerator body.

Figure 7:
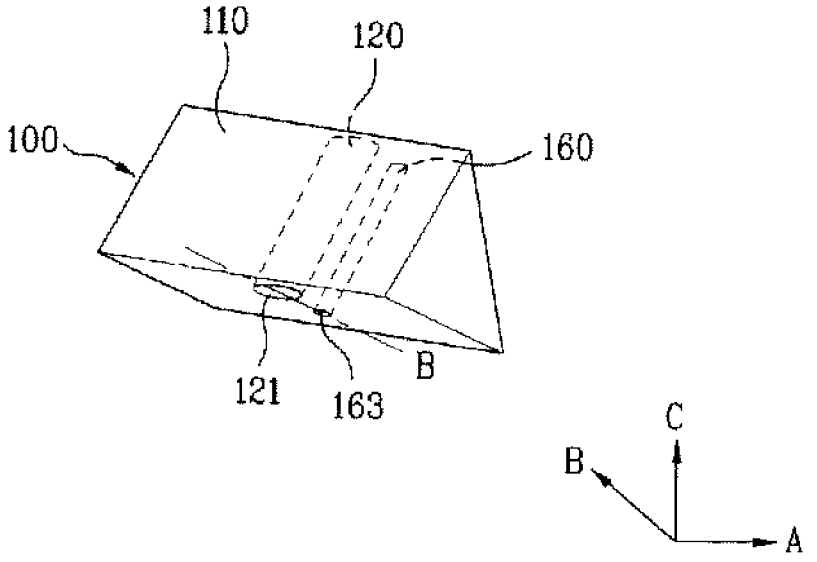
FIG. 7 is a perspective view illustrating another example of a dispensing housing, which may be included in a refrigerator.

FIG. 7 illustrates another example of a dispensing housing. As shown in FIG. 7, the moving chute 120 and water discharge duct 160 may be arranged such that the outlet 121 of the moving chute 120 and the outlet 163 of the water discharge duct 160 are positioned at a lower end of the dispensing cover 110. The outlet 121 of the moving chute 120 and the outlet 163 of the water discharge duct 160 may be spaced apart from each other in the thickness direction B of the refrigerator body.

In this example, based on the position of the outlet 121 of the moving chute 120 and the outlet 163 of the water discharge duct 160, the user may simultaneously dispense water and ice into a container, even when the container is of a relatively small size.

Figure 8:
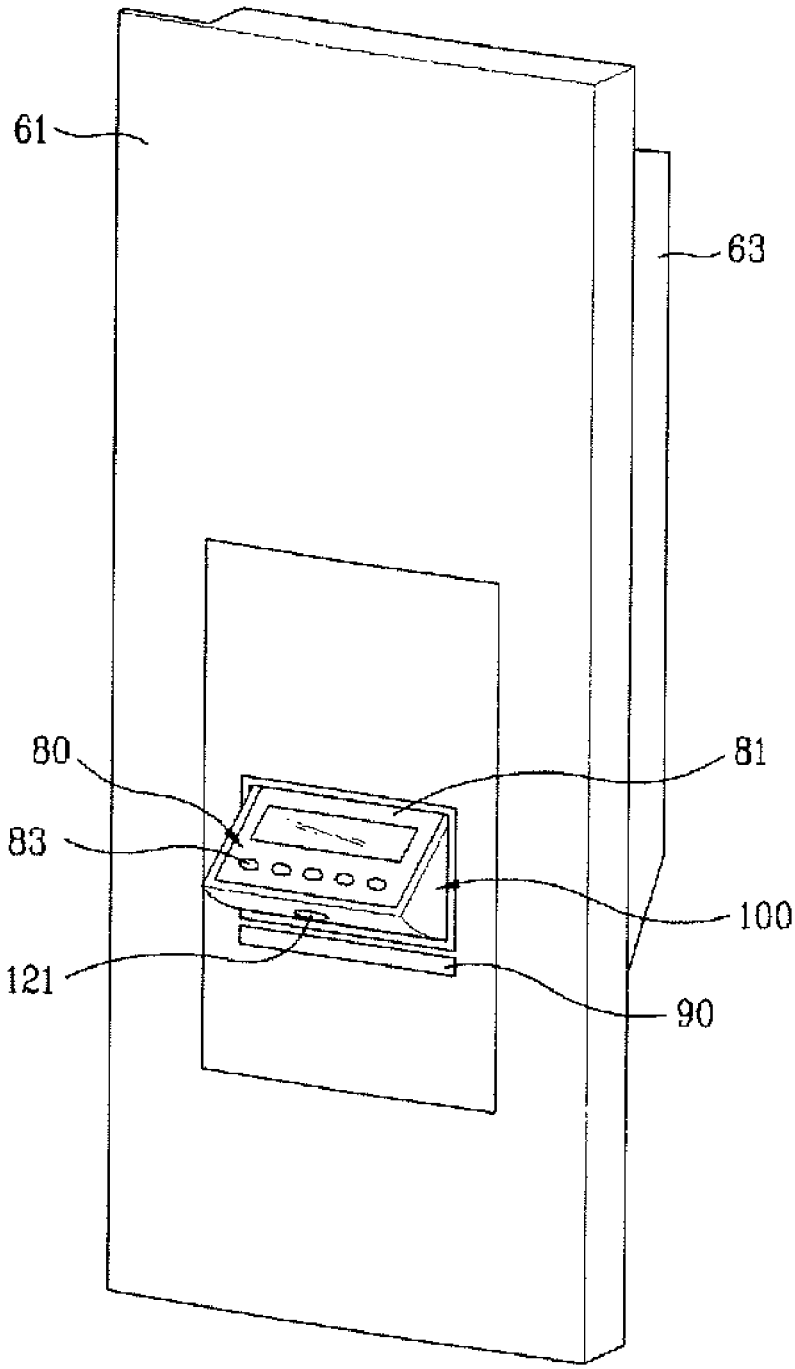
FIG. 8 is a perspective view illustrating a portion of a refrigerator corresponding to a front surface of a door, illustrating a dispenser in an operable position.
Figure 9:
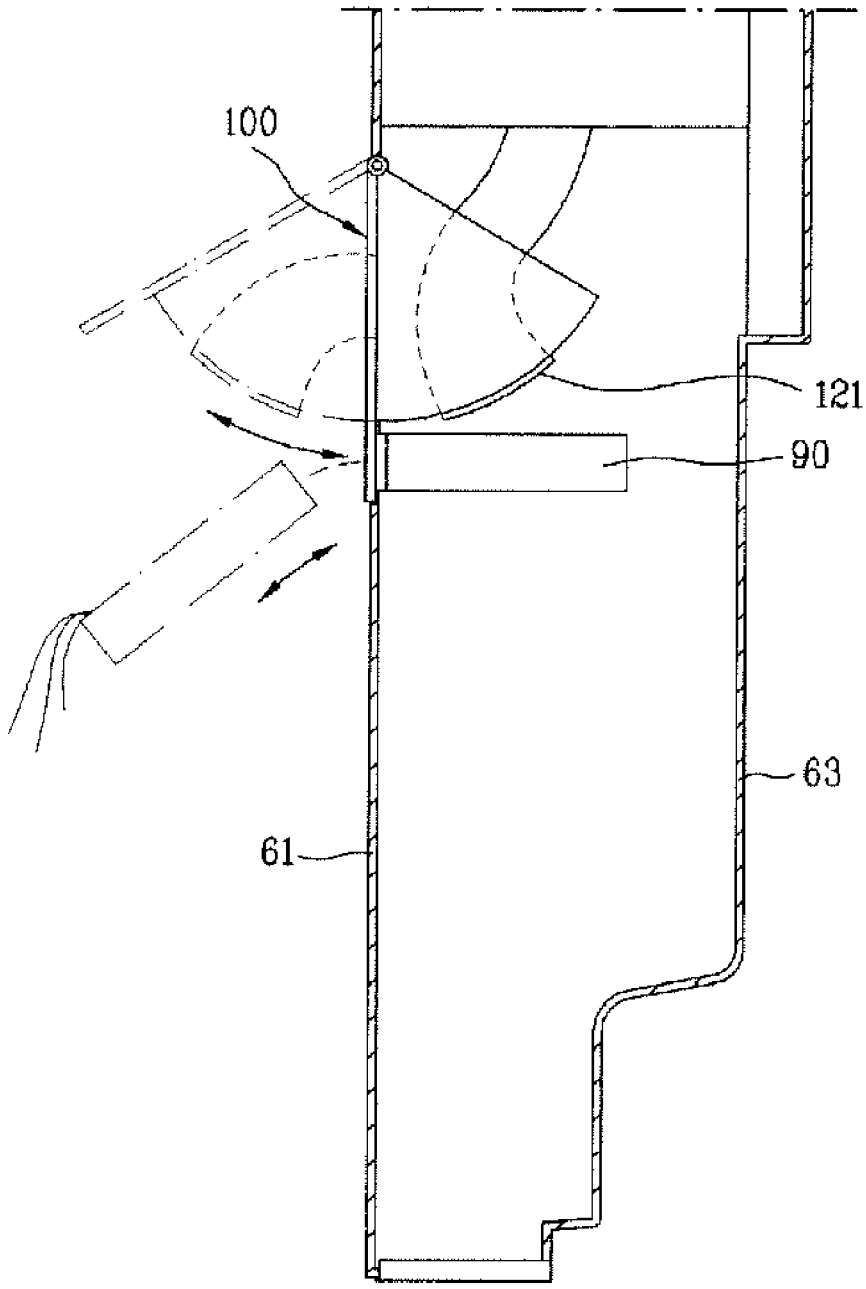
FIG. 9 is a sectional view illustrating the dispenser shown in FIG. 8 moving from a stored position to an operable position.

FIG. 8 shows a portion of a refrigerator corresponding to a front surface of a door, illustrating a dispenser in an operable position, and FIG. 9 illustrates the dispenser shown in FIG. 8 moving from a stored position to the operable position. As shown in FIGS. 8 and 9, the control panel 80 may arranged at the front surface of the dispensing cover ("110" in FIG. 5). Accordingly, when the dispensing cover is moved, the control panel 80 is moved together with the dispensing cover. Because the control panel 80 is arranged at the front surface of the dispensing cover, the space occupied by the control panel 80 on the front frame 61 may be reduced. In addition, when the user views the refrigerator from the front of the refrigerator, the refrigerator may have an aesthetically-pleasing appearance.

In some implementations, a water and/or ice dispensing lever or actuator may be arranged such that it is hidden when the dispensing cover is vertically flush with the front frame 61 or, in other words, in a stored or closed position. In these implementations, the dispensing lever or actuator may be exposed when the dispensing cover is in an operable or open position (e.g., positioned outside of the front frame 61).

The water and/or ice dispensing lever or actuator may be coupled to the dispensing cover at the lower end of the dispensing cover so that, when the dispensing cover is positioned outside of the front frame 61, the water dispensing lever or actuator is exposed.

When the user pushes the water and/or ice dispensing lever with an edge of a container used to receive water and/or ice, water may be discharged through the outlet of the water discharge duct and/or ice may be discharged through the outlet of the moving chute.

A tray 90 may be separably mounted to the door ("60" in FIG. 3) beneath the dispensing cover, to receive residual water discharged after a user has completed dispensing of water or ice. For instance, the tray 90 may be arranged in a space defined between the front frame 61 and the rear frame 63. The tray 90 may receive residual water in an inserted state. For example, water or ice discharged from the dispenser after the dispensing housing or assembly has been returned to a stored or closed position may be received by the tray 90.

The tray 90 also may move separately from the dispensing cover. For instance, when the user desires to remove the water stored in the tray 90, the user may remove the tray 90 from the door and empty the stored water.

In some implementations, the tray 90 may move together with the dispensing cover. For example, in the interior of the door 60, a motor and a motion converting member may be provided. The motor may be configured to generate a force to move the tray 90, and the motion converting member may be configured to convert a rotating force of the motor into a straight linear force to apply to the tray 90. When a signal to enable a movement of the dispensing cover is input to the control panel, the motor may operate, thereby extending the tray 90 to a position outside of the front frame 61. The position outside of the front frame 61 may be under the outlet 121 of the moving chute 120 and/or the outlet 163 of the water discharge duct 160.

Figure 10:
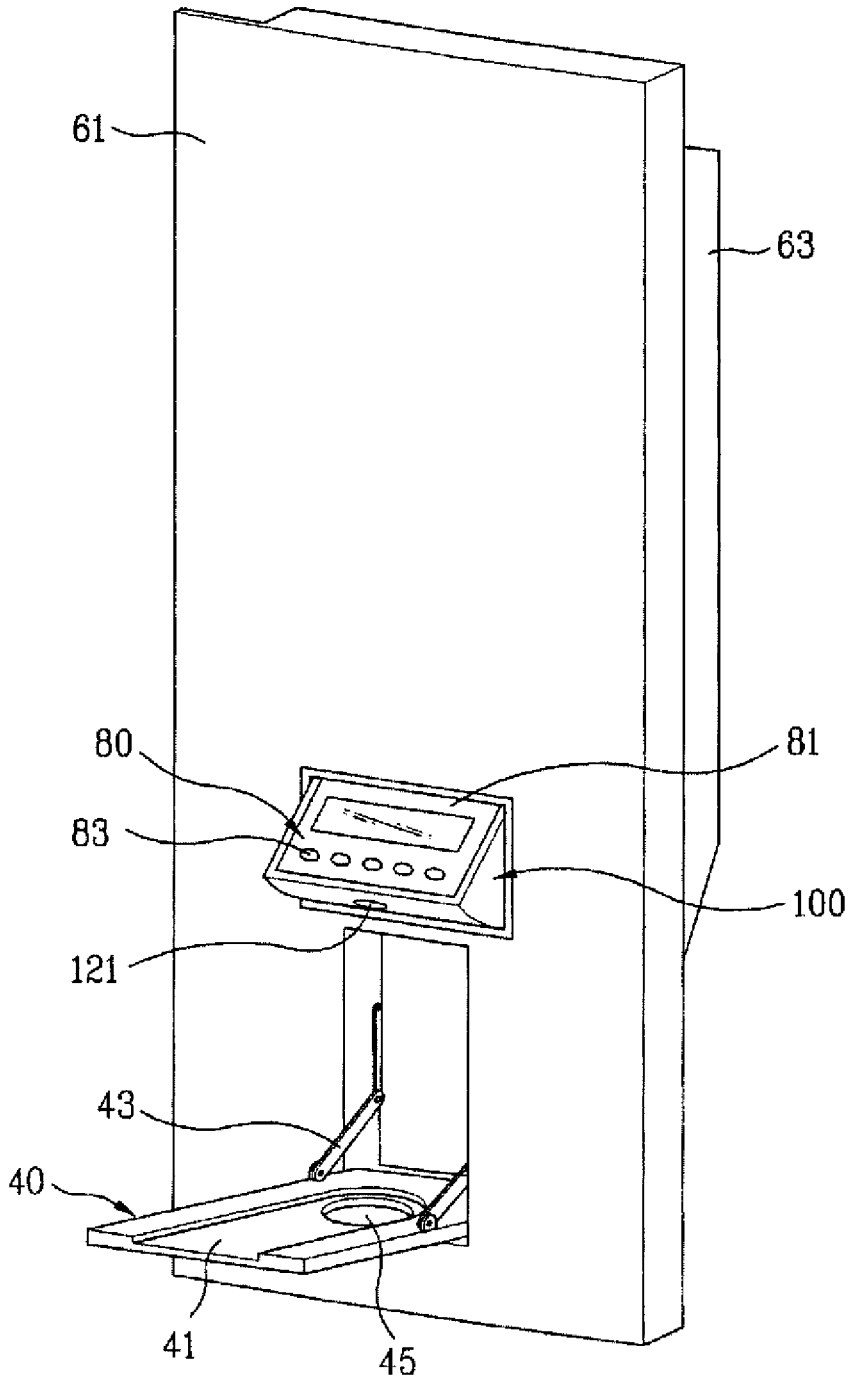
FIG. 10 is a perspective view illustrating a refrigerator including a dispenser and a container support.

FIG. 10 depicts a refrigerator including a dispenser and a container support. The dispenser includes a support 40 configured to support a container in a position to receive water or ice discharged through the water or ice discharge duct.

The support 40 may be pivotally coupled to the front frame 61 of the door by hinges such that the support 40 may move pivotally in accordance with the movement of the dispensing cover ("110" in FIG. 5). For example, when the user provides user input to the control panel 80 to dispense water or ice, the support 40 may be extended out from the door together with the dispensing cover.

In some implementations, the support 40 includes link members 43, and a support panel 41 coupled to lower ends of the link members 43. The link members 43 may attach the support panel 41 to the door 60 in a manner that enables the container support to pivot or rotate from a stored position, in which the support rests against the door 60 or is positioned in a plane parallel to the outer surface of the door 60, to an extended position, in which the support is positioned in a plane perpendicular to an outer surface of the refrigerator door. The support panel 41 may be formed with a container seating portion 45 configured to accommodate a container used to receive water or ice. The container seating portion 45 may be a raised portion of the support panel shaped to receive a container of typical size or may be a hole in the support panel with a diameter corresponding to a container of typical size.

Each of the link members 43 may be connected to the inner surface of the front frame 61 of the door at one end of the link member 43, and may be connected to the support panel 41 at the other end of the link member 43. A coupler ("361" in FIGS. 12A and 12B) may be provided at the support panel 41 and front frame 61. The coupling unit may be coupled to a coupler ("362" in FIGS. 12A and 12B) mounted to the front frame 61 of the door.

A damper ("140" in FIG. 5) may be arranged at the position where the support panel 41 and front frame 61 are coupled, to control the movement speed of the support panel 41.

In place of the above-described link members 43, the support 40 may include a motor for generating a rotating force to move the support 40. In some implementations, the container support 40 may move in a plane perpendicular to the door and a power transmission mechanism may be configured to convert a rotating force of a motor into a straight linear force and apply the straight liner force to the support to cause the support to extend in the plane perpendicular to the door.

For example, the power transmission mechanism may include a pair of gears. That is, the power transmission mechanism may include a first gear coupled to a shaft of the motor, and a second gear mounted to a lower portion of the support panel 41. The second gear may engage with the first gear, and move the support panel outwardly from the front surface of the door.

In this configuration, when the user provides user input to the control panel 80 to dispense water or ice, the dispensing cover may be rotated from a stored position to an operable position outside of the door. At the same time, the motor may be configured to rotate, thereby rotating the first gear connected to the motor. As the first gear rotates, the second gear rotates, thereby moving the support panel 41 outwardly from the front surface of the door.

Figure 12A:
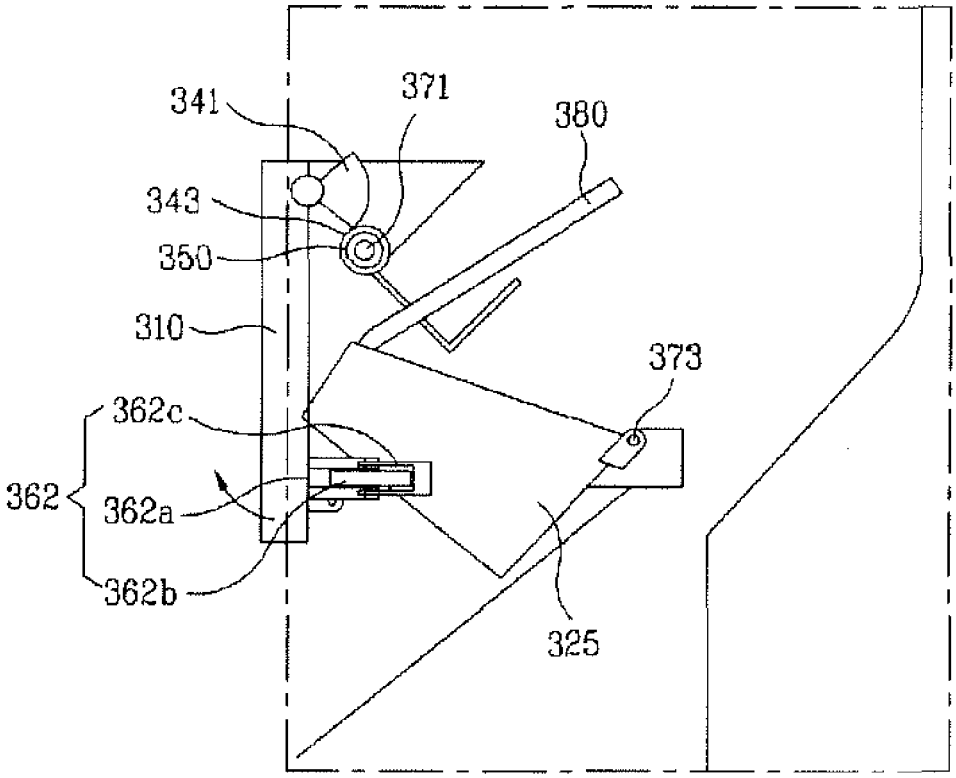
FIGS. 12A and 12B are partial side views illustrating another example of a dispenser.
Figure 12B:
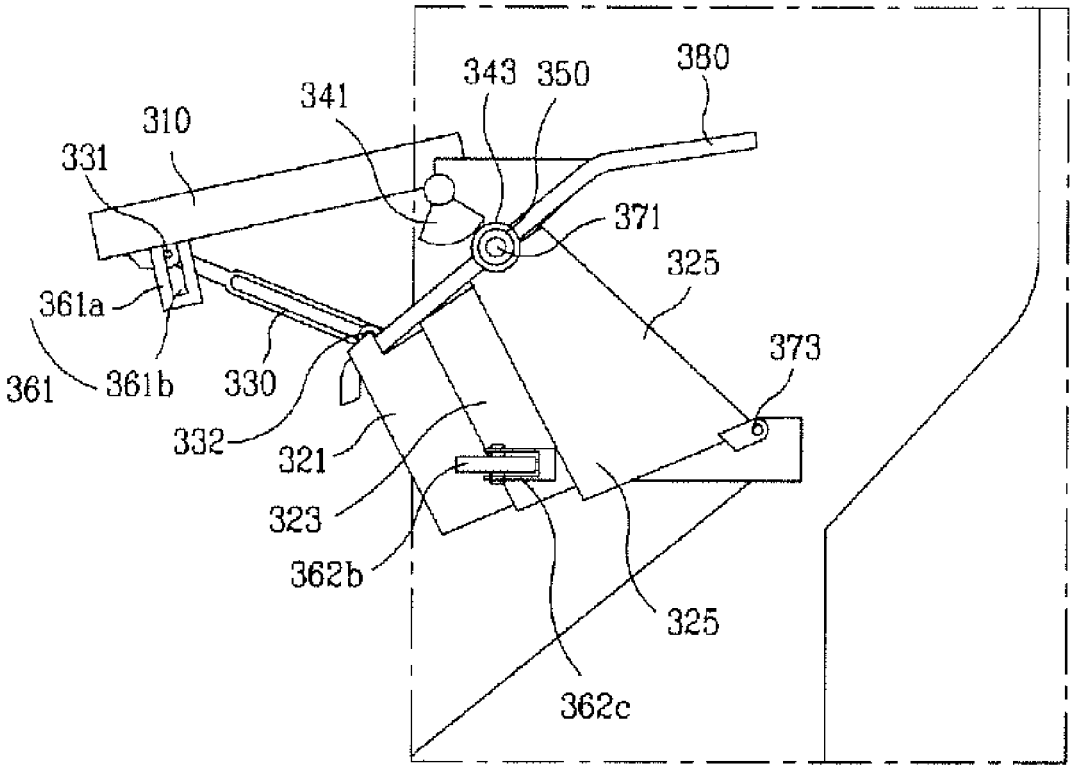

FIGS. 12A and 12B illustrate an example of a dispenser. As shown is FIGS. 12A and 12B, the elastic member 350 applies consistent force to the dispensing cover 310. The force applied to the dispensing cover 310 by the elastic member 350 is in a direction that attempts to pivot or rotate the dispensing cover 310 to a position outside of the door. The movement of the dispensing cover 310 is restrained by a coupling unit.

The coupling unit includes a first coupler 361 mounted to the dispensing cover 310, and a second coupler 362 mounted to the inner surface of the front frame 61 at a position corresponding to the first coupler 361.

In some implementations, the first coupler 361 includes a protrusion 361*a* that extends from the inner surface of the dispensing cover 310 at the lower end of the dispensing cover 310, and a slot or hole 361*b* formed in the center of the protrusion 361*a*.

The second coupler 362 may include a coupling groove 362*a* formed in the front frame 61, a hook 362*b* formed in the coupling groove 362*a* at a position corresponding to the slot or hole 361*b*, and a hook actuator 362*c* configured to rotate the hook 362*b*.

The coupling/separating operation of the first and second couplers 361 and 362 will be described below. When the protrusion 361*a* of the first coupler 361 is inserted into the coupling groove 362*a* of the second coupler 362, the hook 362*b* engages with the protrusion 361*a* and is inserted into the slot 361*b* formed through the protrusion 361*a*. Based on the hook 362*b* being inserted into the slot 361*b* formed through the protrusion 361*a*, the first and second couplers 361 and 362 are coupled.

When the first and second couplers 361 and 362 are coupled and the user pushes the dispensing cover 310 to which the first coupler 361 is attached, the protrusion 361*a* pushes the hook actuator 362*c* of the second coupler 362, thereby causing the hook 362*b* to be separated from the slot 361*b*. Based on the hook actuator 362*c* causing the hook 362*b* to be separated from the slot 361*b*, the coupling between the first and second couplers 361 and 362 is released.

In some examples, the first and second couplers 361 and 362 may be coupled in a manner in which the first coupler 361 includes a hook that engages with the second coupler 362. For example, the first coupler 361 may include a protrusion having an engagement hook, and the second coupler 362 may include a groove having an engagement portion. In this example, one of the first and second couplers 361 and 362 may include an elastic member that forces the engagement hook of the first coupler 361 against the engagement portion of the second coupler 362 to couple the first coupler 361 to the second coupler 362.

A locking device also may be used to control movement of the dispensing housing or dispensing assembly. For instance, when a dispensing button on the control panel is pressed, the locking device releases the mechanism configured to lock movement of the dispensing cover. In this instance, the dispensing cover may be moved outside of the front frame of the refrigerator door by force applied by the elastic member. After a user is finished dispensing ice or water and wishes to return the dispensing housing to a stored or closed position, the user pushes the dispensing cover toward the front frame. As the user pushes the dispensing cover toward the front frame, the locking device may lock the dispensing cover to retain the dispensing housing in the stored or closed position.

In some examples, movement of the dispensing cover or dispensing housing may be automatic or mechanically controlled without application of human force. For instance, the operations to move the dispensing cover or dispensing housing from a stored position to an operable position outside of the front frame or to return the dispensing cover or dispensing housing to the stored position may be automatic. An ejection button and an insertion button may be provided on the control panel and may be configured to activate automatic ejection/insertion of the dispensing cover or dispensing housing.

The automatic ejection/insertion of the dispensing cover may be achieved by an ejection/insertion device. The ejection/insertion device may include a motor, which is controlled by an electrical signal generated in response to a user pressing the ejection button or insertion button, and a power transmission, which transmits a rotating force of the motor to the dispensing cover.

The power transmission may include gears or other mechanisms to convert the rotation of the motor into the pivotal movement of the dispensing cover. Accordingly, when the motor rotates in a forward direction, the dispensing cover is ejected or moved outwardly from the front frame. When the motor rotates in a backward direction, the dispensing cover is returned to a stored or closed position.

The moving chute and water discharge duct may move together with the dispensing cover when they are coupled to the dispensing cover. When the opening and closing of the dispensing cover is controlled by a motor, opening and closing the dispensing cover may be achieved without using a separate damper.

Referring again to FIGS. 3 to 5, the opening and closing operations of the moving chute and dispensing cover may be carried out by a moving device.

In the closed or stored position of the dispensing cover or dispensing housing, that is, in the position in which the dispenser is not operational to dispense water or ice into a container, the front surface of the dispensing cover may substantially flush with the front surface of the front frame 61.

When the dispensing cover or dispensing housing is in the closed or stored position and a user presses the dispensing cover to enable dispensing of ice or water, the coupling between the first coupler, which is attached to the dispensing cover, and the second coupler is released. As a result, the elastic member 150, which is in a compressed state when the dispensing cover or dispensing housing is in the closed or stored position, applies an elastic force to the dispensing cover 110 and moving chute 120, thereby causing the dispensing cover 110 and moving chute 120 to move or rotate outward from the front frame 61.

As the dispensing cover 110 and moving chute 120 move or rotate outward from the front frame 61, the first gear 141 connected to the moving chute 120 controls the opening speed of the dispensing cover 110 and moving chute 120 because the first gear 141 engages with the second gear 143 mounted to the inner surface of the front frame 61 by a mounting plate 145. Based on the configuration of the first gear 141 and the second gear 143, the dispensing cover 110 and moving chute 120 may be slowly moved or rotated outward from the front frame 61. Abrupt movement of the dispensing cover 110 and moving chute 120 may be avoided.

After a user completes dispensing ice or water when the dispensing housing is in an operable position and wishes to return the dispensing housing to a closed or stored position, the user presses or otherwise applies force to the dispensing cover 110. As the user presses or otherwise applies force to the dispensing cover 110, the moving chute 120 is inserted into the inner space of the door and the dispensing housing is returned to the closed or stored position. As the dispensing housing or dispensing cover 110 is returned to the closed or stored position, the first and second couplers engage to retain the dispensing housing or dispensing cover 110 in the closed or stored position.

Figure 11A:
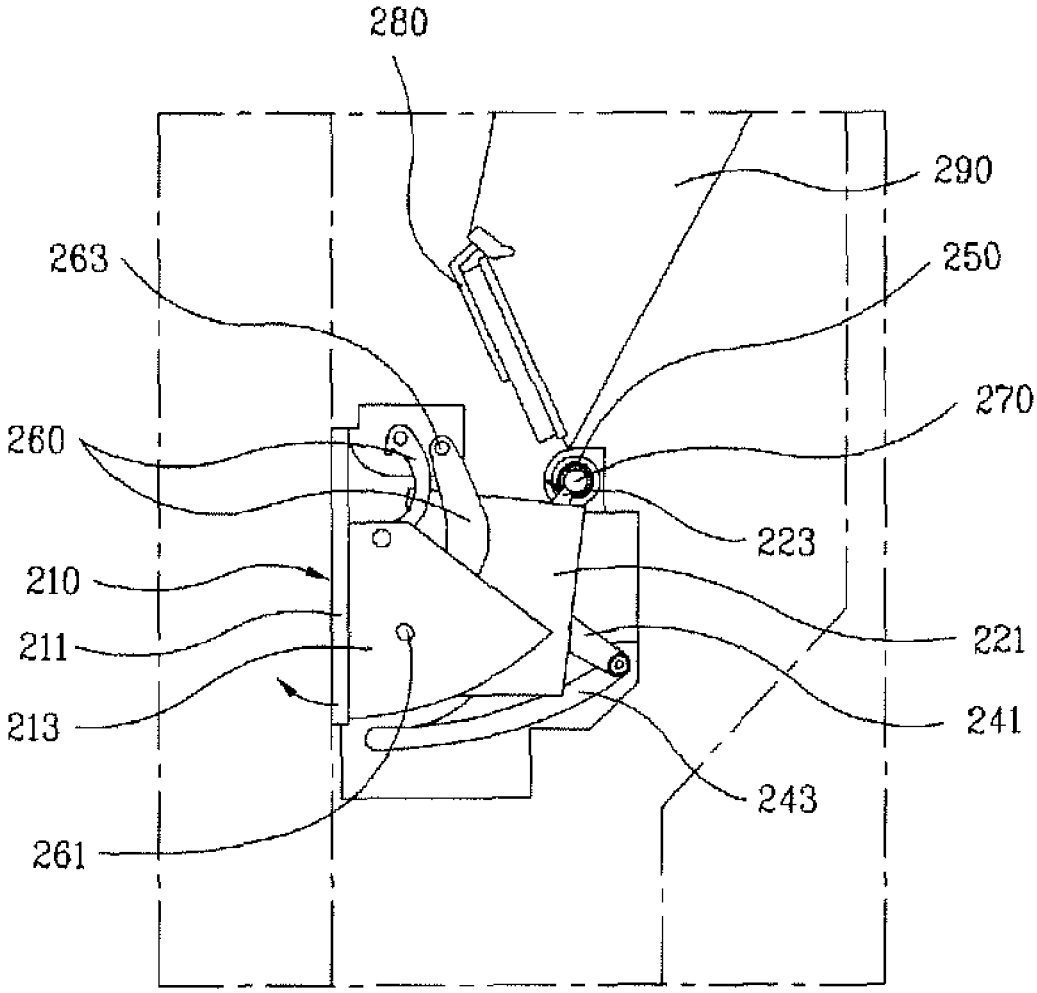
FIGS. 11A and 11B are partial side views illustrating an example of a dispenser.
Figure 11B:
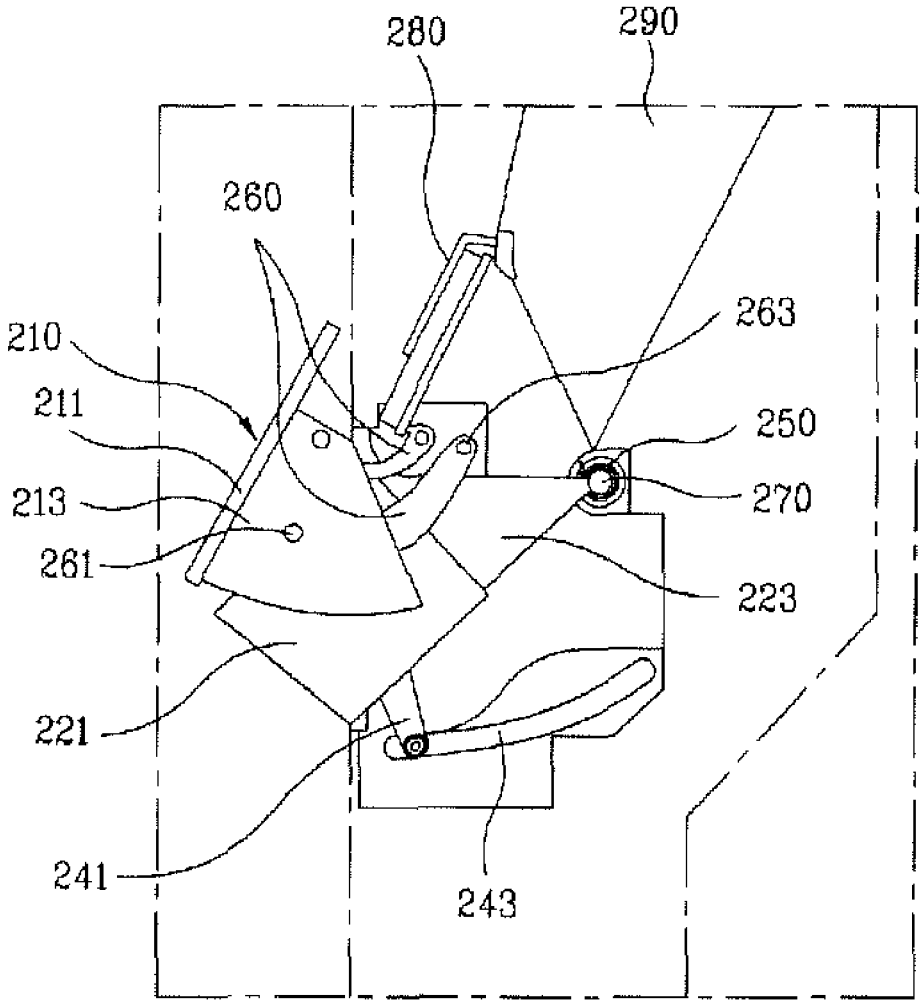

FIGS. 11A and 11B illustrate another example of a dispenser. As shown in FIGS. 11A and 11B, the dispenser includes a moving chute having a foldable structure. The dispenser also includes an elastic member 250 configured to apply an elastic force to the moving chute, a guide including guide elements 241 and 243, a dispensing cover 210 configured to move with the moving chute, and a connecting link 260 configured to guide the movement of the dispensing cover 210.

The moving chute includes a first moving chute 221, which directly receives the force applied by the elastic member 250, and a second moving chute 223, which moves together with the first moving chute 221 in response to movement of the first moving chute 221. In some implementations, the first and second moving chutes 221 and 223 form a foldable structure. In these implementations, when the first moving chute 221 is moved or extended outward from the front frame, the first and second moving chutes 221 and 223 are unfolded based on their relative movement. When the first moving chute 221 is moved or inserted inward from the front frame, the first and second moving chutes 221 and 223 are folded such that they overlap with each other. In the folded position, the second moving chute 223 may be inserted into the interior of the first moving chute 221.

One end of the second moving chute 223 may be pivotally coupled to a hinge pin 270 mounted to the inner surface of the front frame 61. The other end of the second moving chute 223 may be slidably arranged in the first moving chute 221. Accordingly, when the first moving chute 221 moves or extends outward from the front frame 61 by the elastic force of the elastic member 250, the first moving chute 221 slides together with the second moving chute 223.

In some implementations, a torsion spring may be used for the elastic member 250. The torsion spring may be fitted around the hinge pin 270. One end of the torsion spring may be supported by the first moving chute 221, and the other end of the torsion spring may be supported by the inner surface of the front frame 61.

The movement of the first moving chute 221 may apply force to the connecting link 260 to cause the connecting link 260 to move. The movement of the connecting link 260 may cause the dispensing cover 210 to move. For instance, the connecting link 260 may guide the movement of the dispensing cover 210. As the movement of the first moving chute 221 causes the dispensing cover 210 to move, the second moving chute 223 pivots about the hinge pin 270.

In some examples, one end 263 of the connecting link 260 may be pivotally coupled to the inner surface of the front frame 61 by a hinge. In these examples, the other end 261 of the connecting link 260 may be fixedly mounted to a second cover 213 that forms an inner frame of the dispensing cover 210. In other examples, the other end 261 of the connecting link 260 may be mounted to a first cover 211 forming an outer frame of the dispensing cover 210.

When the first moving chute 221 moves, the connecting link 260 pivots about the end 263 of the connecting link 260 that is pivotally coupled to the inner surface of the front frame 61. Because the structure of the connecting link 260 is angled, the connecting link 260 moves the dispensing cover 210 along a path defined by the angle of the connecting link 260.

In some arrangements, the connecting link 260 may include two connecting links. Two connecting links may enable more efficiency or better control in guiding the movement of the dispensing cover 210. One end 263 of the connecting link 260 also may be pivotally coupled to the inner surface of the front frame 61, and the other end of the connecting link 261 may be coupled to both the first moving chute 221 and the dispensing cover 210.

The guide, which includes guide elements 241 and 243, may be mounted to the first moving chute 221 and the inner surface of the front frame 61, and configured to guide the movement of the first moving chute 221. The guide element 241 may include a guide protrusion and may be attached at a lower end of the first moving chute 221. The guide element 243 may include a guide groove that is formed in an inner surface of the front frame 61. The guide protrusion of the guide element 241 may engage or fit into the guide groove 243. Based on the guide protrusion engaging with or fitting into the guide groove, when the first moving chute 221 moves, the structure guides the movement of the first moving chute 221.

In some configurations, the guide protrusion may be formed at the inner surface of the front frame 61, and the guide groove may be formed at the outer surface of the first moving chute 221.

As discussed above, a water discharge duct, through which water may be discharged, may be coupled to the dispensing cover 210. The water discharge duct may include a flexible portion extendable based on movement of the dispensing cover 210. When the dispensing cover 210 is moved or extended outward from the front frame 61, a portion of the water discharge duct also may be moved or extended outward from the front frame 61.

Referring again to FIGS. 12A and 12B, another example of a dispenser may include a dispensing cover 310 configured to move or extend outward from the front frame of the door, and a moving chute configured to move together with the dispensing cover 310 to be positioned outside of the front frame of the door. The dispenser also may include a connecting link 330, which connects the dispensing cover 310 and moving chute, and an elastic member 350, which applies an elastic force to the dispensing cover 310 to cause the dispensing cover 310 to move or extend outward from the front frame.

An upper end of the dispensing cover 310 may be pivotally coupled to a first hinge pin 371 that is fixed to the front frame. The elastic member 350 may be mounted around the first hinge pin 371, to apply an elastic force to the dispensing cover 310. A torsion spring may be used for the elastic member 350.

The moving chute may include a first moving chute 321 directly coupled to the connecting link 330, a second moving chute 323, which is moved in response to movement of the first moving chute 321, and a third moving chute 325, which moves pivotally in response to movement of the second moving chute 323.

One end 331 of the connecting link 330 may be pivotally coupled to the dispensing cover 310. The other end 332 of the connecting link 330 may be pivotally coupled to the first moving chute 321.

In some implementations, when a user presses on a lower portion of the dispensing cover 310 proximate to where the first coupler 361 is arranged, the coupling between the first and second couplers 361 and 362 is released. As a result, the dispensing cover 310 is moved, pivoted, or rotated outward from the front frame based on the elastic force applied by the torsion spring. When the dispensing cover 310 is moved outward from the front frame, the connecting link 330 coupled to the dispensing cover 310 pulls the first moving chute 321.

As the first moving chute 321 is pulled by the connecting link 330, the first moving chute 321 pulls the second moving chute 323 and pivots by an angle. Based on the pivoting of the first moving chute 321, the second moving chute 323 pivots by an angle while being pulled by the first moving chute 321. Movement of the first moving chute 321 and second moving chute 323 applies force to the third moving chute 325, thereby causing the third moving chute 325 to pivot about a second hinge pin 373 based on the pivotal movements of the first and second moving chutes 321 and 323.

The third moving chute 325 may be pivotally supported by the second hinge pin 373, which is fixed to the inner surface of the front frame. In this configuration, the third moving chute 325 pivots in a clockwise direction when the dispensing cover 310 moves or extends outward from the front frame.

When the dispensing cover 310 moves outward from the front frame, the movement speed of the dispensing cover 310 may be controlled by a damper arranged near the first hinge pin 371. The damper may include a pair of gears 341 and 343. The first gear 341 may be mounted to the dispensing cover 310, and the second gear 343 may be mounted to the inner surface of the front frame. The third moving chute 325 may be configured to communicate with an ice discharge duct, and the ice discharge duct maybe configured to communicate with an ice storing container. The ice discharge duct may define an ice passage between the ice storing container and the third moving chute 325. When the dispenser is in an operable position, ice may be guided from the ice storing container to a container positioned outside the refrigerator door through a passage defined by the ice discharge duct, the third moving chute 325, the second moving chute 323, and the third moving chute 321.

A water discharge duct 380, through which water may be discharged, also may be coupled to the dispensing cover 310. Dispensing of water through the water discharge duct 380 may be achieved separately from dispensing of ice or simultaneously with dispensing of ice.

In some examples, when a user desires to dispense a certain content, the user inputs a command to the control panel. The user then pushes the dispensing cover, which is attached to the first coupler. The first coupler releases from the second coupler and the dispensing cover moves outward from the front frame. As the dispensing cover moves outward from the front frame, the moving chute also moves outward from the front frame. After a predetermined time elapses from the movement of the moving chute outward from the front frame, content (e.g., ice or water) is discharged from the moving chute.

In some examples, a separate content (e.g., ice or water) dispensing command may be subsequently input after the moving chute is positioned in an operable position outside of the front frame.

After the content has been dispensed, the user may manually push the dispensing cover such that the moving chute may be returned to a stored or closed position and inserted into the inner space of the door. The dispensing cover and moving chute also may be automatically ejected outside the front frame and inserted inside the front frame. When the moving chute moves outward from the front surface of the door, the movement speed may be controlled by a damper.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a door having a front frame and a rear frame, the front frame and the rear frame defining an interior of the door; and a dispenser comprising a dispensing assembly configured for movement between a stored position and an operable position, the dispensing assembly comprising:

a first moving chute configured to move in response to movement of the dispensing assembly from the stored position to the operable position, an outlet of the first moving chute being positioned in the interior of the door defined by the front frame and the rear frame when the dispensing assembly is positioned in the stored position and the outlet of the first moving chute being positioned outside of the door when the dispensing assembly is positioned in the operable position; and a second moving chute configured to move in response to movement of the dispensing assembly from the stored position to the operable position, the second moving chute and the first moving chute each defining at least a portion of a passage through the door when the dispensing assembly is positioned in the operable position, wherein:

when the dispensing assembly is positioned in the stored position, at least a portion of the first moving chute is positioned inside the second moving chute, and when the dispensing assembly moves from the stored position to the operable position, the portion of the first moving chute extends from the second moving chute.

2. The refrigerator according to claim 1, wherein the dispensing assembly further comprises:

a dispensing cover configured to move outward from the front frame in response to movement of the dispensing assembly from the stored position to the operable position.

3. The refrigerator according to claim 1, wherein the dispenser further comprises:

a fixed chute that, when the dispensing assembly is positioned in the operable position, has one end configured to communicate with the second moving chute and another end configured to communicate with an ice storing container, wherein a combination of the fixed chute, the second moving chute, and the first moving chute define an ice flow passage through the door when the dispensing assembly is positioned in the operable position.

4. The refrigerator according to claim 1, wherein the dispenser further comprises:

a moving device configured to move the dispensing assembly from the stored position to the operable position.

5. The refrigerator according to claim 4, wherein:

the dispensing assembly further comprises a dispensing cover configured to move outward from the front frame in response to movement of the dispensing assembly from the stored position to the operable position, and the moving device comprises:

a hinge configured to enable the dispensing cover to pivot with respect to the front frame;

an elastic member configured to generate an elastic force that is applied to the dispensing assembly to cause the dispensing cover to pivot outward from the front frame; and a coupling unit configured to couple the dispensing cover and the front frame against the force of the elastic member to retain the dispensing assembly in the stored position, the coupling unit being released to enable the dispensing assembly to pivot from the stored position to the operable position.

6. The refrigerator according to claim 5, wherein the coupling unit comprises:

a first coupler mounted to one of the dispensing cover and the front frame; and a second coupler mounted to the other of the dispensing cover and the front frame.

7. The refrigerator according to claim 5, wherein the moving device further comprises:

a damper configured to control a movement speed of the dispensing assembly when the dispensing assembly moves from the stored position to the operable position.

8. The refrigerator according to claim 7, wherein the damper comprises:

a first gear mounted to one of the dispensing cover, the first moving chute, or the second moving chute; and a second gear mounted to one of the front frame or the rear frame in the interior of the door, the second gear being engaged with the first gear.

9. The refrigerator according to claim 5, wherein the moving device further comprises:

a guide configured to guide movement of the first moving chute and the second moving chute.

10. The refrigerator according to claim 5, wherein the moving device further comprises:

a connecting link configured to guide movement of the dispensing cover.

11. The refrigerator according to claim 1, wherein:

the dispensing assembly further comprises a dispensing cover configured to move outward from the front frame in response to movement of the dispensing assembly from the stored position to the operable position, and when the dispensing assembly is positioned in the stored positioned, the dispensing cover is substantially flush with the front frame of the door.

12. The refrigerator according to claim 1, wherein the dispensing assembly further comprises a dispensing cover configured to move outward from the front frame in response to movement of the dispensing assembly from the stored position to the operable position, further comprising:

a water discharge duct coupled to the dispensing cover, to enable dispensing of liquid water when the dispensing assembly is positioned in the operable position.

13. The refrigerator according to claim 12, wherein the water discharge duct has a flexible portion configured to extend and retract based on movement of the dispensing assembly.

14. The refrigerator according to claim 12, further comprising:

a button configured to enable dispensing of water through the water discharge duct, the button being positioned below the dispensing cover when the dispensing assembly is positioned in the operable position.

15. The refrigerator according to claim 12, wherein an outlet of the first moving chute and an outlet of the water discharge duct are positioned at a lower end of the dispensing cover and spaced apart from each other in a width direction of a refrigerator body.

16. The refrigerator according to claim 12, wherein an outlet of the first moving chute and an outlet of the water discharge duct are positioned at a lower end of the dispensing cover and spaced apart from each other in a thickness direction of a refrigerator body.

17. The refrigerator according to claim 1, wherein the dispensing assembly further comprises a dispensing cover configured to move outward from the front frame in response to movement of the dispensing assembly from the stored position to the operable position, further comprising:

a control panel provided on a front surface of the dispensing cover, the control panel being configured to control the dispenser.

18. The refrigerator according to claim 1, wherein the dispensing assembly further comprises a third moving chute configured to move in response to movement of the dispensing assembly from the stored position to the operable position, the third moving chute, the second moving chute, and the first moving chute each defining at least a portion of a passage through the door when the dispensing assembly is positioned in the operable position.

19. The refrigerator according to claim 18, wherein:

when the dispensing assembly is positioned in the stored position, at least a portion of the first moving chute is positioned inside the second moving chute and at least a portion of the second moving chute is positioned inside the third moving chute, and when the dispensing assembly moves from the stored position to the operable position, the portion of the first moving chute extends from the second moving chute and the portion of the second moving chute extends from the third moving chute.

20. The refrigerator according to claim 1, wherein the first moving chute and the second moving chute do not form a passage through the door when the dispensing assembly is positioned in the stored position.

21. A method for controlling a refrigerator, comprising:

receiving, at a control panel, a command to enable dispensing of ice or water;

in response to receiving the command:

moving a first moving chute from a first position in which an outlet of the first moving chute is positioned behind a plane representing an outer surface of a refrigerator door and at least a portion of the first moving chute is positioned inside a second moving chute to a second position in which the outlet of the first moving chute is positioned in front of the plane representing the outer surface of the refrigerator door and the portion of the first moving chute extends from the second moving chute, and moving the second moving chute to a position in which the first moving chute and the second moving chute define a passage through the refrigerator door;

dispensing ice or water through the refrigerator door using the passage defined by the first moving chute and the second moving chute; and enabling movement of the first moving chute from the second position to the first position after dispensing the ice or water.

22. The method according to claim 21, wherein moving the first moving chute comprises controlling a movement speed of the first moving chute.

23. A refrigerator comprising:

a door having a front frame and a rear frame, the front frame and the rear frame defining an interior of the door; and a dispenser comprising a dispensing assembly configured for movement between a stored position and an operable position, the dispensing assembly comprising:

a first moving chute configured to move in response to movement of the dispensing assembly from the stored position to the operable position, an outlet of the first moving chute being positioned in the interior of the door defined by the front frame and the rear frame when the dispensing assembly is positioned in the stored position and the outlet of the first moving chute being positioned outside of the door when the dispensing assembly is positioned in the operable position; and a second moving chute configured to move in response to movement of the dispensing assembly from the stored position to the operable position, the second moving chute and the first moving chute each defining at least a portion of a passage through the door when the dispensing assembly is positioned in the operable position, wherein:

the first moving chute and the second moving chute form a foldable structure such that the first moving chute and the second moving chute are in a folded position when the dispensing assembly is positioned in the stored position and the first moving chute and the second moving chute are in an unfolded position when the dispensing assembly is positioned in the operable position.

* * * * *